United States Patent [19]

Lundberg

[11] 4,314,521

[45] Feb. 9, 1982

[54] METHOD AND APPARATUS IN THE TREATMENT OF UNDERWATER SURFACES OF FIXED OR FLOATING CONSTRUCTIONS

[75] Inventor: Hans G. Lundberg, Löddeköpinge, Sweden

[73] Assignee: Trelleborg Marin Aktiebolag, Trelleborg, Sweden

[21] Appl. No.: 124,045

[22] Filed: Feb. 25, 1980

Related U.S. Application Data

[62] Division of Ser. No. 848,795, Nov. 4, 1977, abandoned.

[30] Foreign Application Priority Data

Nov. 4, 1976 [SE] Sweden ..... 7612280

[51] Int. Cl.[3] ..... B63B 59/00

[52] U.S. Cl. ..... 114/222; 219/72; 228/18; 134/167 R; 15/1.7

[58] Field of Search ..... 219/72; 228/18, 57; 134/167 R; 114/222; 15/385, 1.7

[56] References Cited

U.S. PATENT DOCUMENTS

| | | | |
|---|---|---|---|
| 2,646,889 | 7/1953 | Dvlak | 15/1.7 |
| 3,073,727 | 1/1963 | Mullinix | 15/1.7 |
| 3,216,047 | 11/1965 | Ernolf | 15/385 |
| 3,412,862 | 11/1968 | Chaplin | 15/1.7 |
| 3,604,437 | 9/1971 | Tappan | 134/167 R |
| 3,609,916 | 10/1971 | Hammelmann | 114/222 |
| 4,029,930 | 6/1977 | Sagara | 219/72 |
| 4,084,535 | 4/1978 | Rees | 114/222 |

*Primary Examiner*—Galen L. Barefoot
*Assistant Examiner*—D. W. Keen
*Attorney, Agent, or Firm*—Edwin E. Greigg

[57] ABSTRACT

The disclosure relates to a method and apparatus for treating, primarily cleaning, underwater surfaces of fixed or floating constructions for example, ships' hulls. In the method according to the invention, the treatment or cleaning device, which is rotatably driven by a motor, is wholly or partially insulated from the surrounding water by a medium which is fed to the vicinity of the device. The apparatus according to the invention includes a channel and a connection for supplying the insulating medium in the vicinity of the cleaning device.

16 Claims, 6 Drawing Figures

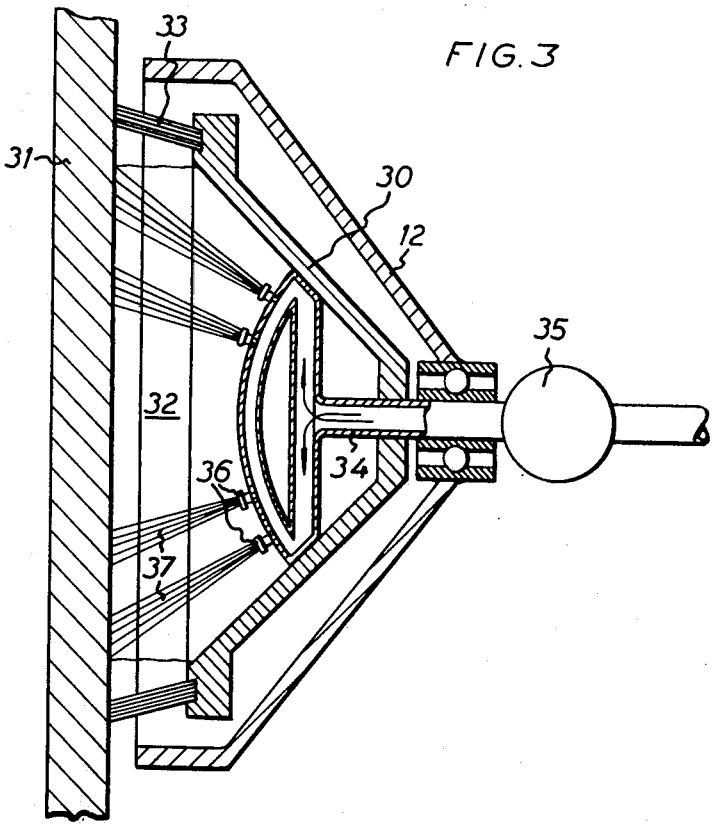
FIG. 3
FIG. 4
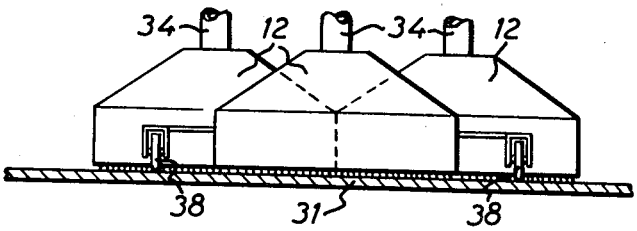

METHOD AND APPARATUS IN THE TREATMENT OF UNDERWATER SURFACES OF FIXED OR FLOATING CONSTRUCTIONS

This is a continuation of application Ser. No. 848,795 filed Nov. 4, 1977, now abandoned.

The present invention relates to a method, in that type of assembly for treating, primarily cleaning, underwater surfaces of fixed or floating constructions, for example ships' hulls, as has a motor and at least one treatment device rotatably driven by the motor, for reducing the water resistance and power loss of the motor caused by the contact of the device with the surrounding water. The invention also relates to an apparatus intended for carrying out this method.

The assembly of the above-disclosed type may either be self-propelled or held by a diver and is normally used for removing growth from ships' hulls, the motors in such assemblies being normally driven hydraulically or by compressed air.

A great problem in assemblies of this type is that the power supplied by the motor is lost to a great extent as a result of the contact of the device with the surrounding water, contact which entails friction, vortex-formation and pump effect, that is to say only a minor portion of the power supplied is available for the treatment proper. Only the pump effect is in actual fact of any assistance, since it creates a low pressure between the device and the vessel hull so that abutment is obtained therebetween. In cases where the device consists of a planar circular brush, it is even possible to obtain considerably higher abutment force than necessary, which leads to increased wear on the brush, increased bearing stresses and difficulty of movement and control.

The major aspect of the present invention is to reduce the above-mentioned power loss by reducing the power requirement and/or increasing the effect of the treatment. A further aspect of the present invention is to make possible a regulation of the necessary but troublesome abutment force between the device and the underwater surfaces of the fixed or floating constructions, and thereby directly or indirectly make possible a compensation for equipment wear. A further aspect of the present invention is to make the entire assembly easy to manouver and easy to move for a single diver.

These and other aspects of the present invention are realized in a simple and effective manner in accordance with the method in that a medium which wholly or partially insulates the rotary device from the surrounding water is fed to the region of the device, the apparatus for carrying out this method being characterized by means located in the region of the rotary device for the supply of the medium.

The nature of the present invention and its aspects will be more readily understood from the following description of the accompanying drawings and discussion relating thereto.

In the accompanying drawings:

FIG. 3 is a longitudinal section of one embodiment in which the apparatus according to the invention has been supplemented with devices for high pressure water rinsing;

FIGS. 4 and 5 are views from the side and from above, respectively, of an embodiment in which three apparatuses according to the invention have been coupled together to a fixed system.

Figure 2:
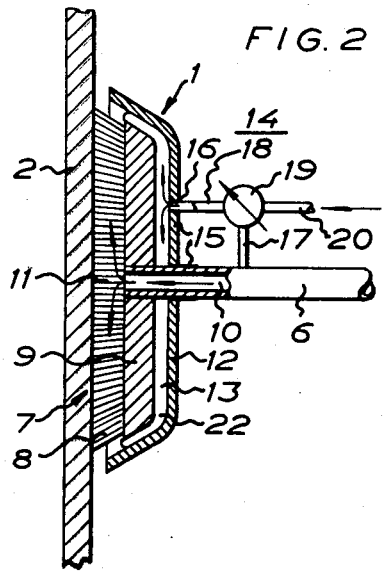
FIG. 2 is a longitudinal section of the embodiment of FIG. 1 with such details as do not form part of the invention having been removed.

The assembly 1 shown on the drawing is intended for cleaning primarily vessel hulls below the water line, that is to say in general the removal of marine growth. A portion of a side plate forming part of the hull is shown at 2, but it should be emphasized that the assembly is equally suited for cleaning the underside of the hull.

Figure 1:
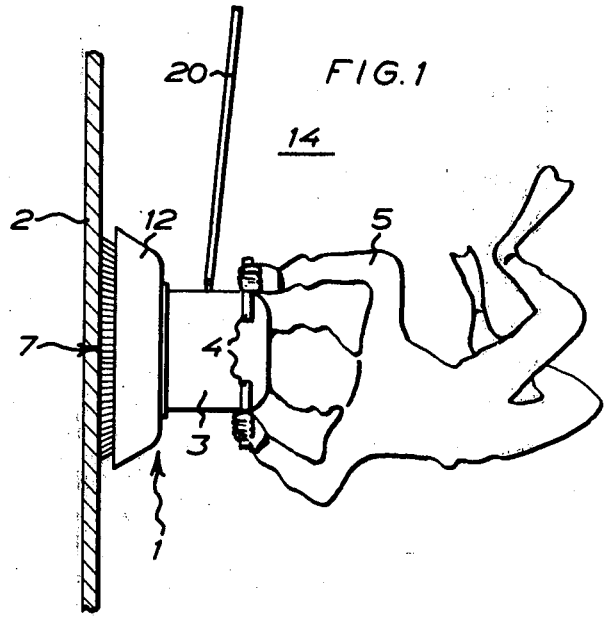
FIG. 1 illustrates schematically from the side the use of a particularly preferred embodiment of the invention.
Figure 6:
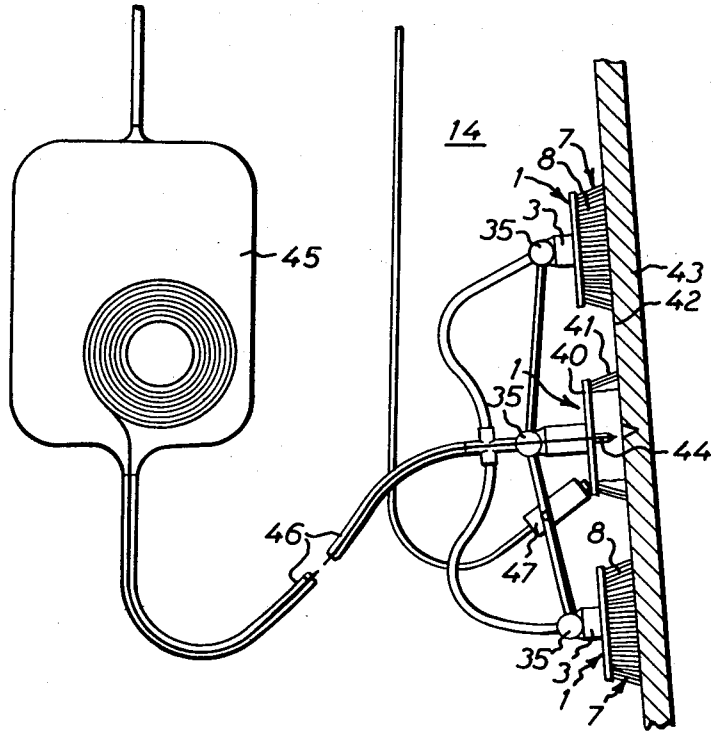
FIG. 6 is a longitudinal section of an embodiment in which the apparatus according to the invention has been supplemented with welding equipment.

The assembly 1 has a motor 3 which is driven hydraulically or by compressed air and is connected by the intermediary of hoses or the like (not shown) to a pump assembly (not shown) located above the water line, and is provided with operating handles 4 which are to be grasped by the hands of a diver 5, please see FIG. 1. On the output drive shaft 6 of the motor 3 (please see FIG. 2) a planar, circular brush assembly 7 is mounted, whose brush 8 is fixed in the normal way to a disk-shaped base 9 and may be moved into abutment against the plate 2 for cleaning thereof. For purposes which will be described below, the drive shaft 6 has an axial channel 10 which discharges at the centre 11 of the brush 7 at the front face thereof, that is to say at the face which is turned towards the plate 2. The brush 7 is, on its rear face (and at its periphery) that is to say on the face turned towards the motor 3 covered by a hood 12 such that a space 13 is formed between the hood and the brush 7 for purposes which will also be described below.

In order to reduce the power loss in the motor 3 as a result of the contact of the brush 7 (also to a certain extent of the drive shaft 6) with the surrounding water 14, and thereby to reduce the power need and/or, by higher motor speed to increase the cleaning effect of the brush 7, a medium 15 (in this case air) which, to a great extent, insulates the brush from the surrounding water 14 is fed or sucked into and around the brush at its centre 11 and the space 13 via the channel 10 in the drive shaft 6 and a connection 16 in the hood 12. The channel 10 and the connection 16 are connected, via conduits 17 and 18 and a regulator valve 19 for manual or automatic control of the air supply, to an accumulator located above the water line via a hose 20, or possibly to the supply hose (not shown) of the motor 3 if the motor is driven by compressed air. By the supply of air 15 in the above-described manner, air bubbles 21 and 22 are formed at the centre 11 of the brush 7 and in the space 13. Experiments have shown that the air bubble 21 in the centre 11 is held captive in a quite stable fashion and assumes oval shape. The air bubble 21 increases in size as a result int.al. of increased supply of air 15 until it covers the major portion of the brushing surface.

The insulating medium need not necessarily consist entirely of air but can be a mixture of air and a liquid, in which case the liquid can have a chemically cleaning effect on the plate 2 or be, for example, a growth-inhibiting or corrosion-protective agent. Instead of air, it is possible to use some other gas or even water vapour.

It should also be pointed out that exactly the same principles as those described above can be utilized in cases where the brush 7 is cylindrical instead of circular.

Moreover, it is possible to couple together several assemblies 1, it being possible, by suitable distribution of the supply of the insulating medium, to realize a movement effect of the coupled assemblies.

High pressure rinsing is a well established method for cleaning, for example, the sides of ships—above the water line—as a preparatory measure for repainting. Below the water line attempts have been made, often with poor results, to clean off concrete or (for inspection purposes) "clean blast" steel in the welded connection points which are difficult to brush and difficult to scrape in offshore constructions. The water pressure varies between 200 and 1000 bar and the effect is often reinforced by sand, slurried in the water.

Among other cleaning objects where plastic and other soft brushes are not capable of removing growth and where the necessary coarse steel brushes may cause scratches which weaken efficiency, mention could be made of bronze propellers which have experienced a far too long down time.

The reasons for the failure of high pressure rinsing in liquid are primarily: the extraordinary energy loss of the jet to the surrounding liquid, which results in a very limited range, the effective area of the jet about the point of impact which is highly restricted by the surrounding liquid, and practical difficulties in distributing the cleaning jets to give efficient coverage, occasioned by the above problems.

In normal operation with divers, there is as a rule no better way of mastering the repulsive reaction force than to direct at least half of the expensive high pressure waterflow in the opposite direction.

The invention obviates all of these disadvantages by means of a single apparatus. It realizes an easily movable air space in which the jets are given "above the water line effect" at the same time as it effectively distributes the jets over larger areas, maintains its station at the cleaning object and may even take care of movement along the surface.

In the embodiment according to FIG. 3, a planar (or, to provide sufficient room for the nozzles, conical in the centre) circular disk 30 is caused to rotate close to a surface 31. Relatively low pressure is created (Bernouilli law) under the disk which is thus sucked towards the surface. If air is blown in, or is allowed to be sucked in, it forces out the water to approximately the outermost third of the radius of the disk. The suction force is then reduced but sufficient suction force remains to counteract the reaction force of the water jets.

Irrespective of how the rotating disk 30 is moved or turned, the air-filled space 32 will remain stable provided the rotating shaft of the disk is as good as perpendicular to the substrate. This can be realized, for example, in that the periphery of the disk is provided with a suitably designed edge, brush 33 or at least three small wheels 38 with radial axles.

Figure 5:
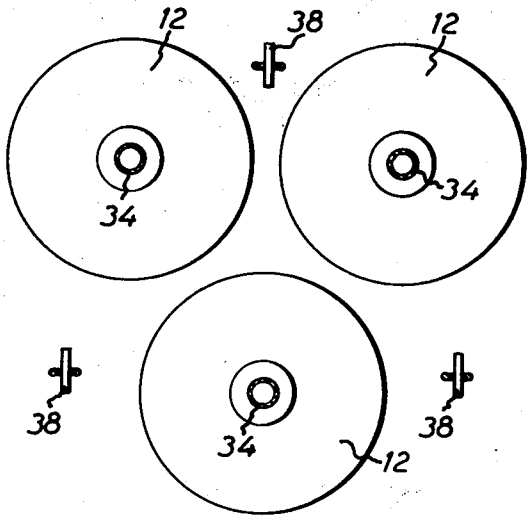

It is also possible to couple together three or more disks 30 with parallel shafts to a fixed system which should then be provided with at least three wheels, oriented in the direction of movement (please see FIGS. 4 and 5). A certain forward motion is obtained by a suitable selection of the interrelated location and rotation directions, this motion becoming considerable if the disks are moreover provided with a brush 33 about their periphery.

The high pressure water is led in through the bored-out shaft 34 of the disk or disks 30 via a rotary coupling (swivel) 35. The water can then be distributed to several nozzles 36 which are directed towards the surface 31 of the cleaning object at different distances from the centre such that the different jets 37 spray concentric circles with suitable mutual spacing.

It is also possible to lead in the water through a fixed shaft about which the disk is journalled. The water flows on into a spherical swivel which accompanies the disk in its rotation at the same time at it is caused in a suitable manner to tilt to and fro. With 1 to 3 nozzles, the entire surface can then be reached by the jets.

The rotation can be achieved by means of suitable direction of the nozzles which do not lie too close to the centre. However, it is probably considerably better to drive the disks by hydraulic motors or in certain cases possibly air motors. It is also conceivable to drive them by means of the rinsing water itself.

Since the water jets constitute a considerable danger to divers, it is desirable to provide a throttle valve which may only be opened and remain open when simultaneously at least two points in the target area of the jets lie adjacent the same metal body. As regards magnetic material, it is possible to make the steel of the object complete an otherwise incomplete iron core in a transformer whose secondary winding is coupled directly or via an amplifier to a magnetically controlled throttle valve. Since the majority of non-magnetic metals (apart from aluminium) are unpainted it is possible, for example, to lead a current through the object between different metal brushes or other contact members and this current can control the throttle valve. For painted light metal other metal detector principles are valid.

Instead of high pressure rinsing with water jets, it is possible, for cleaning purposes, to utilize wet or dry sand blasting or, after the cleaning operation, apply a coat of paint and/or growth-inhibiting or corrosion-protecting agents, it being possible to use either the same nozzles as in the high pressure rinsing with water or other, specially constructed dispensing and applying devices.

With only few exceptions, gas or electric welding in water is of very poor quality, primarily for the following two reasons. First, because of the cooling effect of the water, a far too small zone of the object melts; the smelt is often totally restricted to the additive material. This results in poor fusion or total lack of fusion. Secondly, the welding zone itself has not even had time to solidify before being exposed to the powerful cooling effect of the water. The result is an undesired hardening and possible shrinkage cracks.

Among other inconveniences in wet underwater welding, mention might be made of the fact that the explosive and irregular boiling of the water reduces to a great extent the possibilities of the welder/diver to see what he is doing.

Prior-art methods utilize gas streams for forcing away the water, keeping the welding zone dry and supplying protective gas.

The welding principle described below is probably best suited to so-called MIG welding but there is nothing which prevents other welding methods from being modified accordingly.

A planar circular transparent disk 40 is provided at its periphery on one side with some type of brush 41, wheel or blade, for example of steel. If the disk is allowed to rotate adjacent a surface 42, for example the steel construction 43 which is to be welded, a relatively low pressure is created between the surface and the disk which is consequently sucked towards the surface. The brush, wheel or other device restricts the inward movement and the rotating disk, of a diameter of for example 150 mm, is positioned relatively stability, for example 50 mm from the surface. The rotating, fixedly retained disk can quite easily be moved along the surface of the object.

If a suitable gas or vapour is now allowed in, or formed during the welding, between this protective disk and the welding object, the gas or vapour stays put, if the disk is moved moderately, at least under the central half of the protective disk. The suction force is reduced but is still fully sufficient. The dried treated area of the surface is kept stable in all positions if the peripheral speed is from 5 to 10 m/sec. or higher, which can be achieved with the suggested disk size with less than 1 kW driving force (suitably hydraulic).

Practically speaking, the welding nozzles 44 etc. are allowed to lie in a fixed centre about which the protective disk 40 is journalled with a bearing which is advantageously spherical in order to permit tipping. It is then even easier to allow the welding strand to "pendulate" and it will also be easier to avoid, when necessary, undesirable gas in the centre.

The welding method seem to be particularly suited for MIG-welding, that is to say with a supplied blank thread between whose tip and the welding object a light arc is formed. The characteristics of the current source maintain the length of the light arc almost constant.

A thread magazine, thread supply etc. can be accommodated in a bell 45 which is constantly filled with a good measure of gas (for example of transparent polycarbonate glass) with a connection cable 46 running out from the underside of the bell. The hydraulic motor for the rotation of the protective disk can also here drive the disk via a Bowden-cable. Hydraulic motors for the rotation and thread supply are so small and easily regulated that it is even conceivable to mount them on the fixed handle of the welding nozzle in question.

When remote control is desired, a TV camera 47 is mounted (or a fibre optics eye) outside the transparent protective disk 40. Movement can be achieved by means of hydraulically-driven steered wheels but also by supplementation with one or more counter-rotary, hydraulically parallel-coupled, extra brushes 48 and suitably steered inclination of their axles (of the order of magnitude of a few degrees) and the blowing-in of gas into the extra brushes.

The protective disk with the circumjacent brushes keeps the area being treated dry, lowers the pressure which facilitates welding at greater water depths, keeps the nozzle at a constant distance and brush-cleans the surface before and after the welding nozzle has passed.

What I claim and desire to secure by Letters Patent is:

1. Apparatus for cleaning underwater surfaces such as ships' hulls and the like comprising, in combination, a motor having a shaft, a substantially planar brush mounted on said motor shaft for rotation thereby and having a rear face and a front face for brushing contact with the surface to be cleaned, said shaft having an axial channel terminating in an open end adjacent said brush rear face, conduit means connected to an air supply above the water line for introducing air into said brush through said axial channel open end for emergence at said brush front face to thereby reduce the water resistance and power loss of the motor resulting from contact of the brush with the surrounding water, and means being provided for forming an insulation zone separating the brush from the surrounding water.

2. Apparatus in accordance with claim 1 wherein said brush is of circular configuration and wherein said air is introduced into the center of said brush at said rear face.

3. Apparatus in accordance with claim 1 including a hood disposed adjacent the rear face of said brush in spaced relationship therewith to define a space extending substantially around the periphery of said brush and throughout said brush rear face and wherein said air is introduced into said space.

4. Apparatus in accordance with claim 1 including fluid pressure regulating means connected to said conduit means for controlling the pressure of the air introduced into said brush.

5. Apparatus in accordance with claim 1 including a liquid dispersed within the air introduced into said brush.

6. A method for cleaning underwater surfaces such as ships' hulls and the like comprising the steps of positioning a rotatably driven substantially planar brush having a front surface and rear surface with said front surface in submerged contact with the surface to be cleaned;

introducing air into said brush for emergence at said front face to thereby reduce the contact of said brush with the surrounding water;

rotating said brush during said air introducing step to thereby reduce the water resistance and power loss of the motor resulting from contact of the brush with the surrounding water, and forming an insulating zone separating the face of the brush from the surrounding water.

7. A method in accordance with claim 8 including the step of positioning a hood adjacent the rear face of said brush in spaced relationship therewith to define a space extending substantially around the periphery of said brush and throughout said brush rear face and introducing air into said space.

8. A method in accordance with claim 6 including the step of mixing a liquid with the air introduced during said introducing step.

9. A method for cleaning underwater surfaces such as ships' hulls and the like comprising the steps of positioning a rotatably driven substantially planar brush having an air recycling front surface and an air receiving rear surface space being disposed rearwardly of said front surface and said brush being in submerged contact with the surface to be cleaned;

introducing air into both front and rear air receiving surface spaces of said brush for emergence at said front face space to thereby reduce the contact of said brush with the surrounding water;

rotating said brush during said air introducing step to thereby reduce the water resistance and power loss of the motor resulting from contact of the brush with the surrounding water, and forcing said air into an insulation zone separating the face of the brush from surrounding water.

10. A method in accordance with claim 9 including the step of positioning a hood adjacent the rear face of said brush in spaced relationship therewith to further define said rear surface space extending substantially around the periphery of said brush and throughout said brush rear face and introducing air into said space.

11. A method in accordance with claim 10 including the steps of mixing a liquid with the air introduced during said introducing step.

12. Apparatus for cleaning underwater surfaces such as ships' hulls and the like comprising, in combination, a motor having a shaft, a substantially planar brush mounted on said motor shaft for rotation thereby and having an air receiving front face space and an air receiving rear face space, said front face space for engaging brushing contact with the surface to be cleaned, said shaft having an axial channel terminating in an open end means adjacent said air receiving rear face space, conduit means connected to an air supply above the water line for introducing air into each of said air receiving front and rear face spaces of said brush through said axial channel, open end means for emergence at said brush front face space to thereby reduce the water resistance and power loss of the motor resulting from contact of the brush with the surrounding water, and means being provided for forming an insulation zone separating the face of the brush from the surrounding water.

13. Apparatus in accordance with claim 12 wherein said brush is of circular configuration and wherein said air is introduced into the center of said brush at said rear face space.

14. Apparatus in accordance with claim 12 including a hood disposed adjacent the rear face of said brush in spaced relationship therewith to further define said air receiving rear face space extending substantially around the periphery of said brush and throughout said brush rear face and wherein said air is introduced into said air receiving reaf face space.

15. Apparatus in accordance with claim 12 including fluid pressure regulating means connected to said conduit means for controlling the pressure of the air introduced into each of said air receiving front and rear face spaces of said brush.

16. Apparatus in accordance with claim 12 including a cleaning liquid dispersed within the air introduced into said brush.

* * * * *